United States Patent [19]

Siegel

[11] 3,961,659

[45] June 8, 1976

[54] PREFABRICATED WINDOW UNIT

[76] Inventor: Helmut Siegel, Heidelberger Strasse 10, D-6833 Kirrlach, Germany

[22] Filed: Oct. 10, 1974

[21] Appl. No.: 513,877

[52] U.S. Cl. ..... 160/26; 160/23 R; 160/323 B

[51] Int. Cl.[2] ..... A47H 1/00; A47H 1/13

[58] Field of Search ..... 160/26, 23 C, 23 R, 160/319, 322, 323

[56] References Cited

UNITED STATES PATENTS

| | | | |
|---|---|---|---|
| 146,414 | 1/1874 | Voorhees | 160/26 |
| 159,307 | 2/1875 | Defrenne | 160/26 |
| 505,494 | 9/1893 | Durnbaugh | 160/23 R |
| 559,019 | 4/1896 | Zugermayer | 160/26 |
| 582,243 | 5/1897 | Trumble | 160/322 |
| 602,553 | 4/1898 | Casselberry | 160/323 B |
| 1,147,188 | 7/1915 | Rojas | 160/26 |
| 1,167,929 | 1/1916 | Quinn | 160/323 B |
| 1,263,329 | 4/1918 | Lark | 160/23 R |
| 1,323,159 | 11/1919 | Crane | 160/319 |
| 2,575,128 | 11/1951 | Renzetti | 160/323 R |

*Primary Examiner*—Paul R. Gilliam
*Assistant Examiner*—Victor N. Sakran
*Attorney, Agent, or Firm*—Hans Berman

[57] ABSTRACT

A prefabricated window unit has a rectangular frame whose four elements each consist of two spacedly parallel members. A housing for a sliding shutter is received between the members of the lintel element. The retractor for the operating strap of the shutter is mounted between the two members of one of the jamb elements. A base member and a sill member constitute the fourth frame element.

2 Claims, 6 Drawing Figures

II
7
14
6
IV
IV
8
15
2
3
1
12
III
III
4
11
20
5
13
21
10
9
II

PREFABRICATED WINDOW UNIT

This invention relates to prefabricated building units, and particularly to a prefabricated window unit.

It is common practice to assemble window frames remote from a construction site, and to install the frames with or without the windows proper in suitably prepared openings of a building wall. If the window is to be equipped with external sliding shutters, space for the shutter housing is provided in the wall above the window opening, and guides for the shutter are mounted on the window frame.

The necessary proper alignment between the shutter and the guides requires special care in installing the window frame and the shutter housing, and the cost of the required skilled labor has frequently prevented the installation of external sliding shutters where they would be most useful for the sake of security, additional thermal and acoustical insulation, and for other obvious advantages.

It has now been found that the cost of installing sliding shutters can be reduced substantially, when the shutter housing and the operating mechanism for the shutter are built into a prefabricated window unit remote from the construction site in a shop or factory where the necessary alignment of the component parts is achieved without difficulty.

The window unit of the invention thus comprises a rectangular frame including a pair of elongated, spacedly parallel, first frame elements and a pair of spacedly parallel second frame elements elongated at right angles to the first elements which they connect. As delivered to the construction site, each frame element has an outer face exposed to the atmosphere and directed away from the other element of the pair. The frame elements bound a window opening in the frame. An elongated housing adapted to contain a rolled-up sliding shutter is fastened to one of the second frame elements and connects respective longitudinally terminal portions of the first frame elements. One of the first frame elements carries the operating mechanism for moving the sliding shutter between an inoperative position in which it is substantially completely received within the afore-mentioned housing and an operative position in which it blocks the window opening.

Other features and many of the attendant advantages of this invention will readily be appreciated as the same becomes better understood by reference to the following detailed description of a preferred embodiment when considered in connection with the appended drawing in which.

Figure 1:
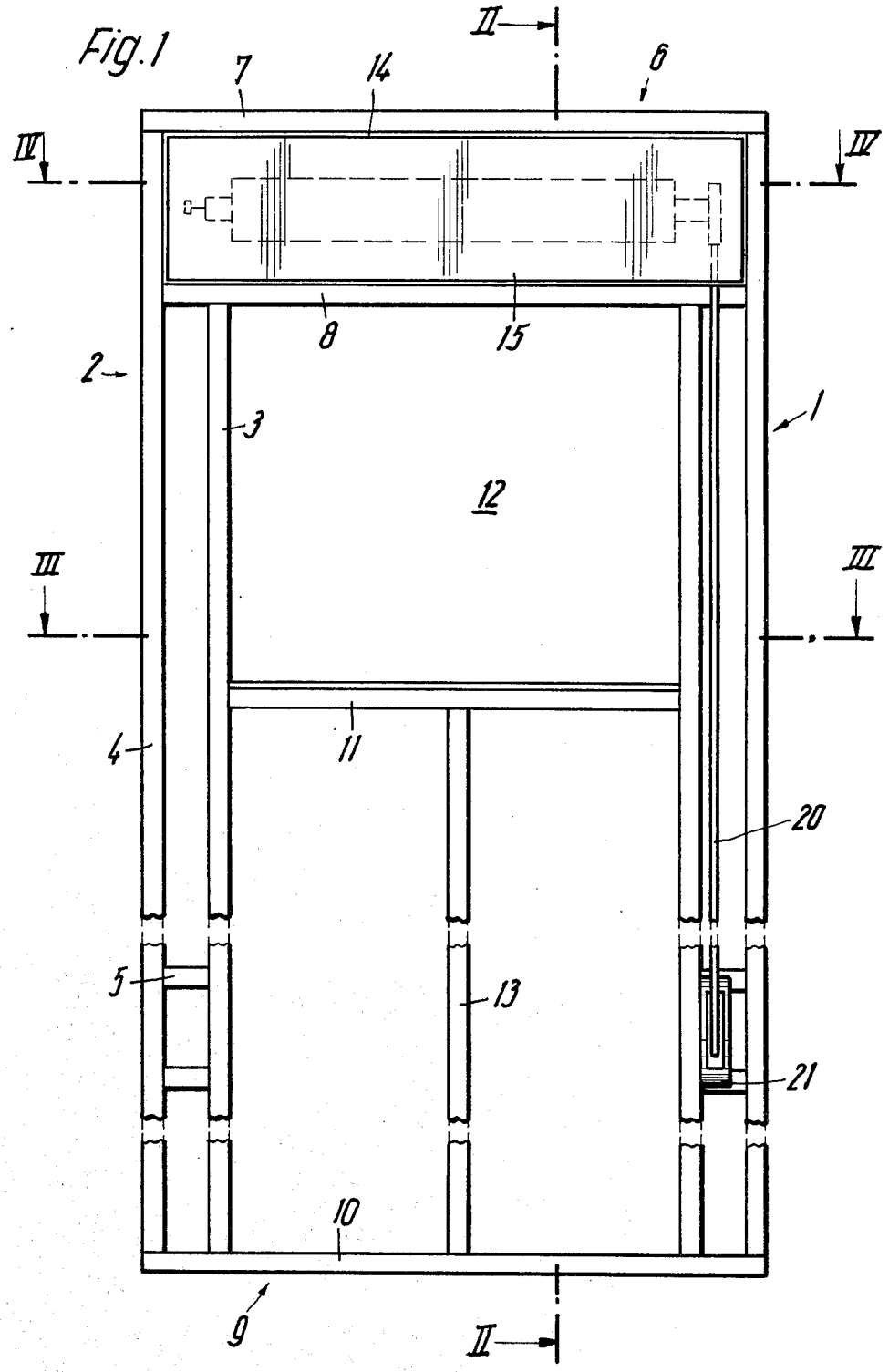
FIG. 1 shows a window unit of the invention in fragmentary, rear elevation.
Figure 2:
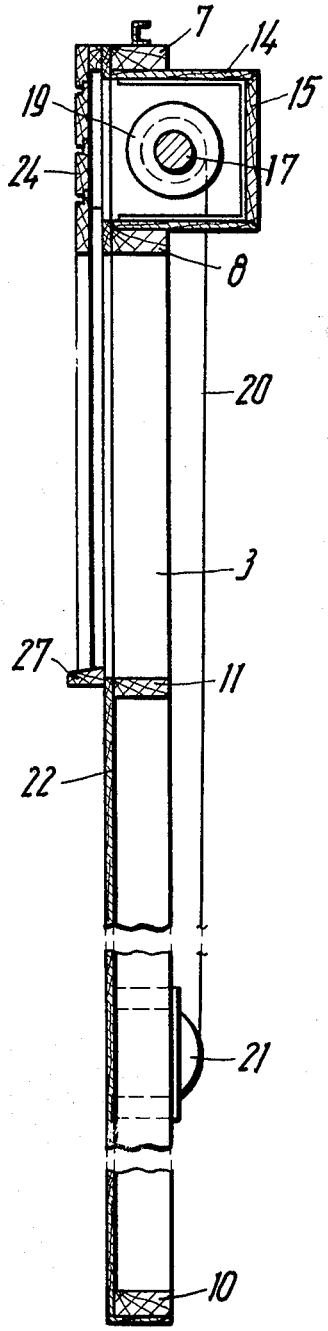
FIG. 2 illustrates the unit of FIG. 1 in side-elevational section on the line II—II.
Figure 3:
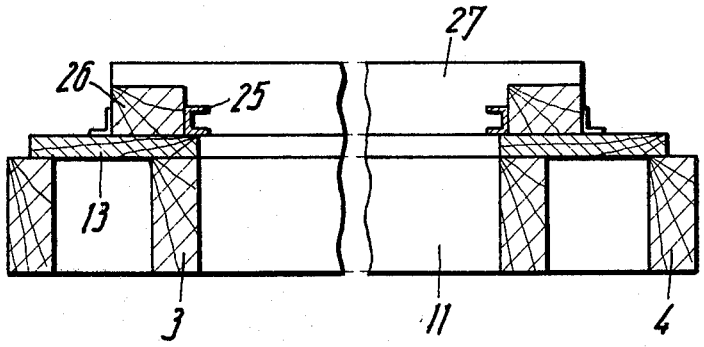
Figure 4:
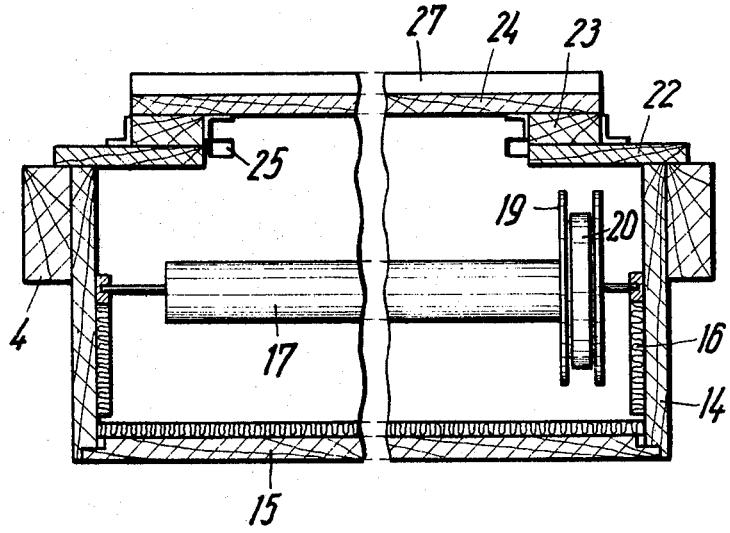
Figure 5:
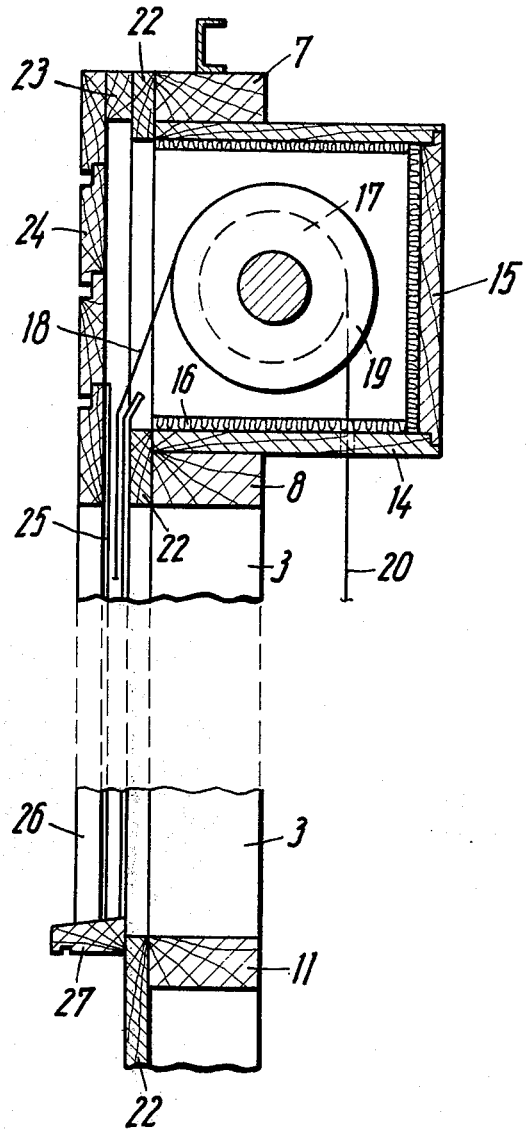

FIGS. 3 and 4 respectively show the unit of FIG. 1 in plan sections on the lines III—III and IV—IV;

FIG. 5 shows portions of the device of FIG. 2 on a larger scale; and

Figure 6:
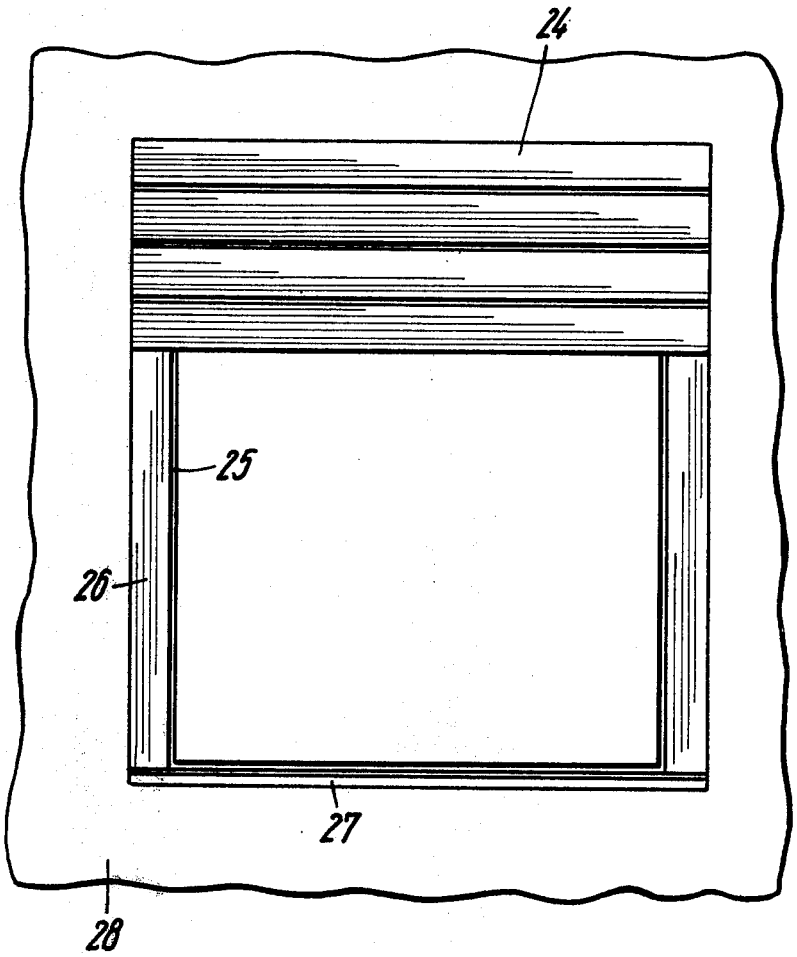

FIG. 6 illustrates the window unit in front elevation in the installed condition.

Referring initially to FIG. 1, there is shown a prefabricated window unit of the invention whose basic structure is a rectangular frame. The two identical jamb elements 1, 2 of the frame each have a shorter inner member 3 and a longer outer member 4, the two members being parallel and separated by spacers 5.

The lintel element 6 of the unit has an outer lintel member 7 connecting the upper ends of the outer jamb members 4 and an inner lintel member 8 connecting the upper ends of the inner jamb members 3 and projecting beyond the inner jamb members to the outer jamb members 4. The fourth frame element 9 consists of a base member 10 on which the four jamb members 3, 4 rest, and a sill member 11 which divides the inner space of the frame into a window opening 12 and into a lower aperture normally closed by a panel omitted from the showing of FIG. 1. An upright, supporting stile 13 extends between the base member 10 and the longitudinal center of the sill member 11. The structure described so far consists entirely of wood in the illustrated window unit, the several members being fastened to each other by means of dowels, not shown.

A horizontally elongated housing 14 is fixedly mounted in the rectangular opening formed by the lintel members 7,8 and the portions of the outer jamb members 4 upwardly projecting beyond the inner jamb members 3. The housing 14 consists of chipboard panels and is open forward and rearward. It is closed rearwardly by a removably fastened, flat cover 15 of the same material. As is better seen in FIGS. 2, 4, and 5, the housing 14 projects rearwardly beyond the common plane of the frame elements 1, 2, 6, 9 far enough to be approximately flush with the inner surface of the building wall in which the unit is to be installed.

As is best seen in FIG. 4, the projecting portion of the housing 14 is provided with a liner 16 of thermally and acoustically insulating material. A roller 17 journaled in the housing 14 for rotation about a normally horizontal axis carries a sliding shutter 18 in the inoperative condition of the latter, the shutter being omitted from FIG. 4, and a pulley 19. A flat tension member which is a woven or braided strap 20 is fastened to and partly wound on the pulley 19. It extends downward from the projecting part of the housing 14 along the jamb element 1 to the pulley 21 of a retractor unit, conventional in itself and mounted between the members 3, 4 of the jamb element 1 on spacers 5. As is conventional, and not shown in detail, the sliding shutter 18 consists of flexible, spacedly parallel bands which carry normally horizontal slats.

Except for the window opening 12 and the central front of the housing 14, the front side or outside of the frame is covered by a plywood panel 22. Flat spacer boards 23 are mounted on the panel 22 around three sides of the front opening of the housing 14 and carry a decorative outer cover 24 of vertically juxtaposed, parallel boards connected by groove and tongue joints. The sliding shutter 18 extends outward of the housing 14 and downward between the two upright spacer boards 23 in a plane outwardly offset from the common plane of the frame elements 1, 2. The shutter is guided along the outer face of the panel 22 in metal channels 25 whose upper ends are mounted on the opposite narrow edges of two spacer boards 23, as is best seen in FIG. 4 and which are otherwise mounted on vertical facing strips 26 attached to the outer face of the panel 22 on either side of the window opening 12. The strips 26 and the channels 25 terminate at a horizontal ledge 27 whose upper face slopes obliquely outward of the window opening 12 and downward in approximate horizontal alignment with the sill member 11 (FIG. 5).

When the window unit of the invention is installed in a wall 28, as is shown in FIG. 6, only the decorative cover 24, the facing strips 26, the channels 25, and the ledge 27 are visible from outside the building.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A window unit comprising, in combination:

a. a rectangular frame including a pair of elongated, spacedly parallel first frame elements and a pair of spacedly parallel second frame elements elongated at right angles to said first elements and connecting said first elements, 1. said frame elements being located in a common plane,
2. each frame element including an inner member and an outer member spacedly parallel to said inner member,
3. said outer members having respective outer faces directed away from the associated inner members and exposed to the ambient atmosphere,
4. said inner members bounding a window opening in said frame,
5. the outer members of said first elements having respective terminal portions projecting longitudinally beyond the associated inner members,
6. the outer member of one of said second frame element being fixedly fastened to said terminal portions and connecting the same, 7. the inner member of said one second frame element being fixedly fastened to each of the outer and inner members of said first frame elements and connecting the same,
8. said members of said one second element and said terminal portions jointly bounding a rectangular opening,
9. the outer member of the other second element connecting respective longitudinal ends of the outer and inner members of said pair of first elements, and
10. the inner member of said other second frame element connecting the inner members of said first elements;

b. an elongated housing adapted to enclose a rolled-up sliding shutter, 1. said housing being received in said rectangular opening and fixedly connected to said one second element, and
2. said housing being fixedly fastened to said terminal portions and connecting the same; and c. operating means mounted on one of said first elements for moving a sliding shutter between an inoperative position and an operative position, said sliding shutter being substantially completely received within said housing when in said inoperative position, and said shutter blocking said window opening in said operative position thereof.

2. A unit as set forth in claim 1, wherein said inner and outer members of said first elements and the inner and outer members of said other second element define therebetween spaces open transversely to said common plane, the unit further comprising a panel member parallel to said common plane and closing said spaces.

* * * * *